US005686677A

United States Patent [19]

Herbert

[11] Patent Number: 5,686,677

[45] Date of Patent: Nov. 11, 1997

[54] ACOUSTIC GUITAR BRIDGE SUPPORT

[76] Inventor: Howard Herbert, 2655 River Rd., Bensalem, Pa. 19020

[21] Appl. No.: 631,256

[22] Filed: Apr. 12, 1996

[51] Int. Cl.[6] ..... G10D 3/04

[52] U.S. Cl. ..... 84/307; 84/298

[58] Field of Search ..... 84/307, 298, 299, 84/291

[56] References Cited

U.S. PATENT DOCUMENTS 976,428 11/1910 Benson et al. ..... 84/298
3,892,159 7/1975 Houtsma ..... 84/307

*Primary Examiner*—Michael L. Gellner
*Assistant Examiner*—Shih-yung Hsieh

[57] ABSTRACT

My device applies to acoustic guitars which have bridges glued to the guitar top. My device securely joins the bridge to the guitar top. Sometimes the tension of the strings pulling on the bridge separates it from the guitar top. My device attacks this problem by using a cross member support bar, which bears upon braces glued to the underside of the guitar top. Screws or other fasteners, threaded through the cross member support bar, guitar top, and bridge, joins them securely. The cross member support bar and fasteners may be installed during the original manufacturing process or added later after the musician has dislodged or separated the bridge partially or wholly from the guitar top. The effect of the cross member support bar, fastened to the bridge in the above manner, is to improve the sound of acoustic guitars.

1 Claim, 2 Drawing Sheets

ACOUSTIC GUITAR BRIDGE SUPPORT

BACKGROUND—FIELD OF INVENTION

My invention concerns acoustic guitar bridges. It eliminates the problem of bridges separating from the guitar top by means of a cross member support bar fastened to the bridge through the guitar top and bearing on the bracings attached to the underside of the guitar top. The appearance of the guitar is not changed. Braces are attached under the guitar top to strengthen the thin top and improved the sound. Manufacturers have not used these braces to attach the bridge to the guitar top as in my invention. The effect of my device is to improve the sound of the guitar without impacting the appearance of the guitar.

Many guitar bridges are glued to the top of the guitar. The tension of the strings pulling on the bridge sometimes partially or completely separates the bridge from the top. The tension of the strings occasionally forces the top of the guitar to bow up or slightly balloon. These problems make the guitar unusable and are overcome by my invention.

The purpose of U.S. Pat. No. 3,892,159, Houtsma, Jul. 1, 1975 is the same as my invention to stabilize the bridge. But Houtsma had far more elaborate mechanisms. Houtsma objectives three and four are to prevent the bridge from tilting and to stabilize the bridge. Houtsma stabilizes the bridge 17 by using a bridge plate 22 attached directly to underside of the guitar top 7 and bridge 17 using dowels. This structure must be completed during the original manufacturing process. My invention uses a cross member support bar bearing upon existing braces rather than attached directly to the guitar top. Houtsma's bridge plate 22 purpose is to support brackets 25 and pins 2 attached to braces *24a* and *24b*, which are not glued to the guitar top but rather attached to braces 21. Again this mechanism must to be in the original manufacturing process of the instrument. The purpose of the brackets 25 and pins 2 are to stabilize bridge 7 and keep it from tilting. All of the above devices significantly effect the appearance of the guitar. My invention has the same purpose but has a much simpler structure and does not effect the appearance of the guitar. It uses a cross member support bar and fastener(s) which could be originally manufactured or could be used to repair a bridge that separated from the guitar top.

Many patents use screws, wires, braces, to attach the bridge to the guitar top. The purpose of these techniques was not to attach the bridge securely to the guitar top. They focused on several purposes, including adjusting the height of the bridge, U.S. Pat. No. 3,440,921 McCatry, U.S. Pat. No. 3,605,545, Rendell, U.S. Pat. No. 4,253,371 Guice, and improve the sound of the guitar, while U.S. Pat. No. 4,178,827 Mallory U.S. Pat. No. 4,026,181 Bareus, stabilize or adjust the height of the guitar top, and U.S. Pat. No. 4,206,678 Guerrero, U.S. Pat. No. 2,473,980 Wilner, U.S. Pat. No. 5,260,505 Kendall, stabilize the bridge by adding an auxilary bridge below the guitar top and using a rod or string to compensate for the string tension. All of these devices effect the appearance of the guitar.

U.S. Pat. No. 2,473,980 Willnet, Jun. 21, 1949 describes an earlier device to prevent the guitar top or sounding board from warping. It reinforced or trussed the top by using tress wires attached from a brace near the neck and to a sturdy piece attached to the bottom. By using different tensions on the wires the top could be moved up or down. This device requires the be manufactured in this manner. It could not be added to an existing guitar as could my invention. Also this device requires several additional pieces side to side and from front to back to strengthen the top so that the truss wires will not collapse or crush the top, which are not required in my invention. This device radically changes the appearance of the guitar.

U.S. Pat. No. 3,440,921, T. M. McCatry, Apr. 29, 1969 describes a movable saddle member which uses screws at both ends of the bridge to raise and lower the saddle in relation to the top. The screws appear to be located similar to my invention but are used for different purposes. McCatry uses the screw to raise and lower the saddle member, while my screw/bolt in my invention is used to attach securely the bridge and saddle to the guitar top. The two screws significantly effect the appearance of the guitar.

U.S. Pat. No. 4,178,827, Mallory, Dec. 18, 1979 describes a parabolic shaped bottom along with specially pattern of braces designed to improve the sound. Mallory uses two screws at either end of the bridge to fasten the specially designed braces through the bridge, braces and guitar top. Two long braces extend from front to back and four short braces fan out from the screw points. Mallory requires the braces in the guitar to be manufactured in the particular manner so that the screws would be attached to the long braces as well as the four braces which fan out from the screw point. In Mallory's device the bridge will not separate from the guitar top. My invention has a cross member support bar element separate from the braces. The cross member support bar rests, contacts, or bears upon the braces and is fastened to the bridge through the guitar top. Thus my invention may be used in many guitars, but not Mallory's, because mine does not depend on Mallory's specially designed brace system. My invention would not be obvious from Mallory's device because the Mallory brace design, with screws to the bridge was integral to the special design of the molded bottom. The purpose of both is to improve the sound. My invention is distinct in that it keeps the bridge from separating from the guitar top, and is suitable for many different guitars. Clearly the molded bottom changes the appearance of the guitar.

U.S. Pat. No. 4,253,371, Guice, Mar. 3, 1981 is one of several patents which raises and lowers the bridge. They are similar to my invention because they use screws at both ends of the bridge to adjust the height of the bridge. But my screws, fasteners, are used to securely attach the bridge to the guitar top, rather than adjust the height of the bridge. Guice's drawings illustrate some superficial resemblance to my invention because of the single screw in the middle of the carrier (bridge) member. Guice's invention separates the top from the strings. The strings are attached to the back through a rear block, side block, guide frame, and carrier member which holds the strings. The screw slides the carrier member up and down the guide frame. Thus the whole purpose of the screw is different from my invention and the purpose and design of Guice's invention is different my invention. The screws and bridge significantly effect the appearance of the guitar.

Several other patents also have screws similar to my invention, but they are used to adjust the height of the bridge, rather than to secure it to the guitar top. The include U.S. Pat. No. 2,709,388 May 31, 1955, Allers, U.S. Pat. No. 4,425,832 Jan. 17, 1984 Peavey, which also uses screws to adjust the bridge fore and aft, U.S. Pat. No. 1,889,408 Nov. 29, 1932 Larson, U.S. Pat. No. 4,230,014 Oct. 28, 1980 Hashino, which also uses screws to adjust the bridge fore and aft. Although these patent use screws to attach the bridge to the guitar top, the purpose of the screws are to adjust the height of the bridge. Thus the purpose of the screws are different from my invention. They use screws to adjust the height, whereas my invention uses screws/fasteners to attach the bridge securely to the guitar top, using a cross member support bar bearing on the braces underneath the guitar top. Because the screws are used to adjust the height of the bridge they change appearance of the guitar.

One invention, U.S. Pat. No. 647,173 Apr. 2, 1900 Almcrantz uses thumbscrews to obtain a removable adjustable bridge. Thus the purpose of the screws differs from my invention.

Several early patents use dowels to attach the bridge through the guitar top using reinforcing plates under the guitar top. They include U.S. Pat. No. 474,432 May 10, 1892 Wolfam and U.S. Pat. No. 536,846 Apr. 2, 1895 Bates. The dowel/fasteners have the same purpose as my screw/fastener (s) and both have reinforcing plates. But neither uses the braces to secure the bridge to the guitar top. It would be difficult to retrofit their invention on existing guitars without removing the guitar top, a delicate operation.

Several early patents use screws to attached metal bridges to reinforcing plates under the guitar top. They differ from my invention because the bridge is metal, not wood, and the reinforcing plate under the guitar top is attached directly to the top, rather than bearing on the braces as in my invention. They include U.S. Pat. No. 754,938 Mar. 14, 1904 Reach, U.S. Pat. No. 976,428 Nov. 22, 1910 Benson et al, U.S. Pat. No. 1,170,999 Feb. 8, 1916 Schultz, U.S. Pat. No. 1,230,695 Jun. 19, 1917 Fickert, and U.S. Pat. No. 2,029,135 Jan. 28, 1936 Stanley et at. These patents use metal bridges and thus were not glued to the guitar top as in my invention. They used reinforcing plates under the guitar top to attach the screws. The reinforcing plates are attached directly to the top. In my invention the cross member support bar bears on the braces, which are attached to the underside of the guitar top. The effect of using the braces to support the bridge is to improve the sound. The metal structure permits the bridge to be shaped differently and this significantly effects the appearance.

My invention does not change the appearance of the acoustic guitar significantly. The cross member support bar is hidden beneath the top of the guitar. The fasteners, whether screws, dowels or other fasteners are mostly hidden from view. Only the top or head of the fastener can be seen where enters the bridge. During the original manufacturing, the head of the fasteners can be disguised in many ways. Thus the results will not effect the appearance of the guitar.

During the original manufacture of the guitar, it may be possible to hide the fastener by only partially penetrating the bridge. The fastener could not be seen from the top and therefore the appearance of the guitar would not change at all.

The design of the bridge may hide the head of the fastener through items used to make the bridge more colorful.

The hidden process of introducing my invention could not be used on existing guitars because a hole must penetrate through the existing bridge and guitar top so that the fasteners may pass through the hole.

OBJECTS AND ADVANTAGES

Accordingly, several objects and advantages of the present invention are:

(a) to provide a means to securely attach the bridge to the guitar top so that it does not separate from the top.

(b) to provide a cross member support bar which does not touch the bottom or sides of the guitar box. Attachment of the cross member support bar to the bottom or sides of the guitar may affect the sound detrimentally.

(c) to provide a cross member support bar which changes the vibration of the top minimally. My invention's cross member support bar is attach to the guitar top and moves in unison with it.

(d) the effect of my invention's cross member support bar attaching the bridge to the guitar top improves the sound of the guitar.

(e) to provide this cross member support bar with minor changes to the structure of the guitar. The bar and fastener(s) are new elements added to the guitar structure. A hole(s) is drilled through the bridge, guitar top, and bar. A fastener(s) is threaded through the bridge, guitar top, and bar and securely attaches them together. The bar rests, contacts, or bears upon the diagonal bracings attached to underside of the guitar top.

(f) A crafts person can repair an existing guitar with the problem of a bridge separated from the guitar top and or bowed top. My invention will repair the guitar without affecting its aesthetics.

(g) My invention can be installed by a firm during the manufacturing of a guitar.

(h) My invention provides a simple process for strengthening the structure of the guitar with the effect of improving the sound of the guitar, without affecting the aesthetic appearance of the guitar.

DESCRIPTION OF THE DRAWINGS

Drawing Figures

REFERENCE NUMERALS IN DRAWINGS

Figure 1:
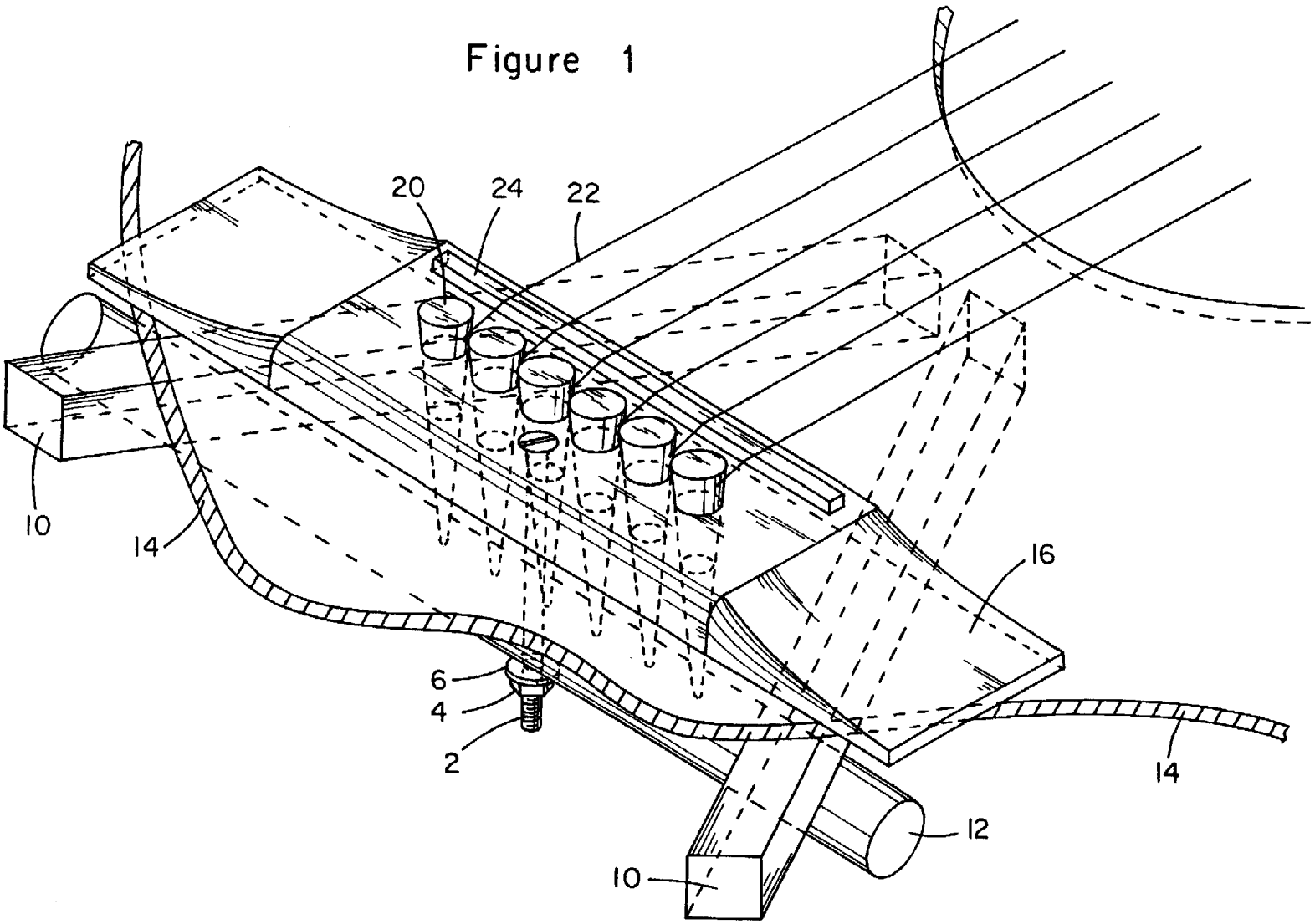
FIG. 1 is a perspective of the invention.

2 bolt
4 nut
6 washer
10 diagonal bracings
12 cross member support bar
14 top of guitar
16 bridge
20 string pins
22 strings
24 saddle/mound

DESCRIPTION FIGS. 1 TO 4

Figure 2:
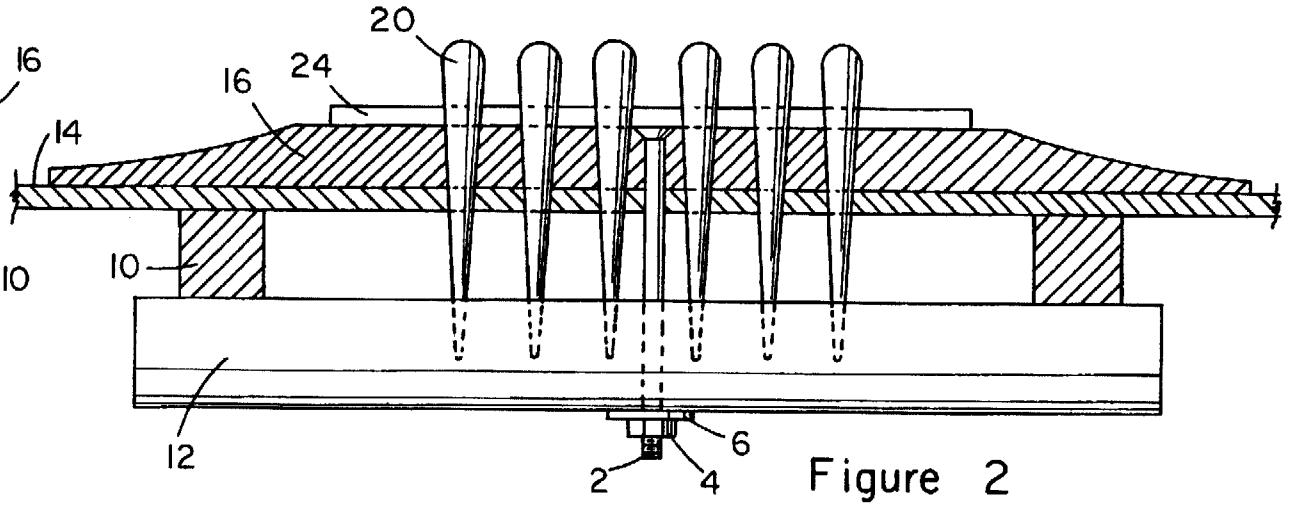
FIG. 2 is an exploded view of the bridge, top, diagonal bracing, cross member support and fastener.
Figure 3:
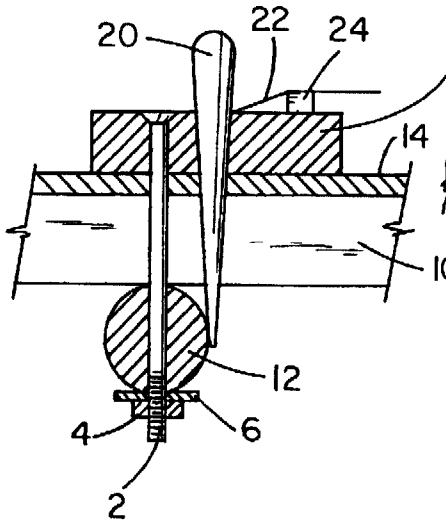
FIG. 3 shows a side view.
Figure 4:
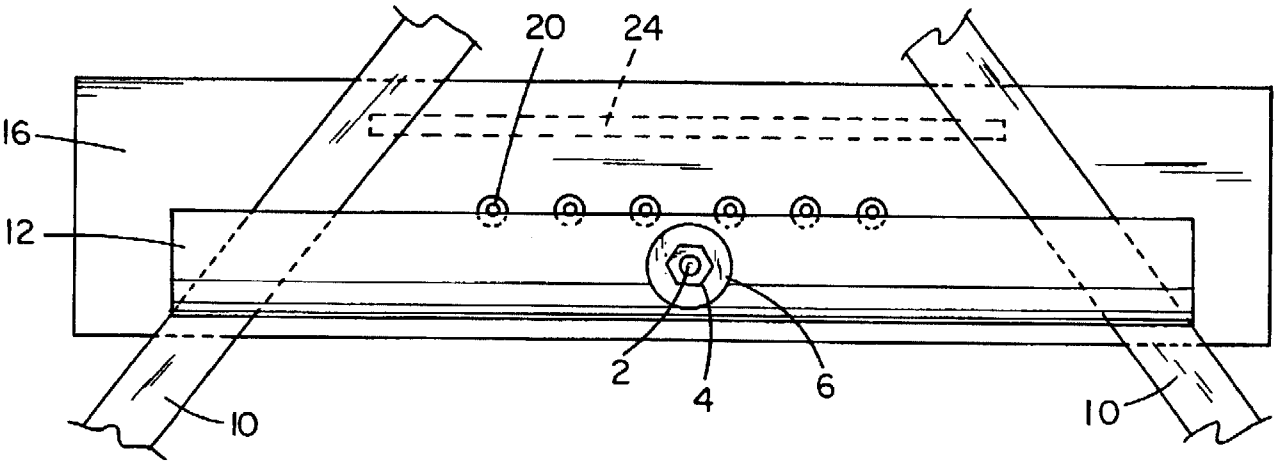
FIG. 4 shows an underside view.

The preferred embodiment of my invention is illustrated in FIG. 1 isometric view of the guitar top bridge area and FIG. 2 is an end view of the bridge area, FIG. 3, a side view, and FIG. 4, an underside view of the bridge area. FIG. 1 illustrates a typical construction of the bridge 16 of a guitar. The guitar top 14 has diagonal braces 10, underneath the top. Only two braces are illustrated, but usually more braces are used to strengthen the guitar top.

The bridge 16 is attached to the top. The pins 20 which hold the strings 22 are inserted into holes 30 in the bridge. The pins may or may not penetrate the cross member support bar 12. Some guitars use hooks to tie the strings to the bridge. This method of attaching the strings to the bridge is not illustrated. My invention applies to these two methods of attaching the strings to the bridge as well as other methods.

The saddle/mound 24 is attached to or is an integral part of the bridge and forms the mound over which the strings cross over the bridge to the neck of the guitar.

My invention adds the fastener(s), bolt 2, nut 4, washer 6, and cross member support bar 12 to the guitar. The fastener is shown as a nut and bolt but other means may be used to fasten the cross member support bar to the bridge, such as screws, dowels, wires, enlarged biscuits used to join pieces of wood, etc. The cross member support bar is shown as a cylindrical dowel made of wood, but other shapes, sizes and materials may be used to support the bridge.

The hole(s) through the bridge, guitar top and cross member support bar is used thread the fastener through them to attach them. This illustration uses a nut, bolt and washer as the fastener. The nut and bolt method permits the fastener to adjust the tension between the bridge, top and cross member support bar.

Different size bridges or different braces designs used by guitar manufacturers may require different embodiments of my invention.

From the description above the several advantages of the bridge cross member support bar become evident:

(a) The cross member support bar firmly attaches the bridge to the top thereby eliminating the problems of the bridge separating from the guitar top and the top bowing or ballooning because of the tension from the strings.

(b) My invention adds the fastener(s) and the bar to the structure of the guitar. A crafts person could make the improvements described above on an acoustic guitar.

(c) The effect of my invention may be to improve the guitar sound.

(d) During the original manufacture of the acoustic guitars, other means may be used to attach the cross member support bar.

SUMMARY, RAMIFICATIONS, AND SCOPE

Accordingly, the reader will see that the cross member support bar greatly improves the chances of repairing defective guitar bridges and guitar tops. Only the fastener(s) and cross member support bar are added to the guitar structure. These two members pull the bridge and guitar top together and restore them to their original position.

While the above figures and description add the two parts, fastener(s) and cross member support bar, other means could be used to achieve the same results. The fastener could use other meaning besides the nut and bolt shown. The cross member support bar could be made of other than shown shapes, sizes, and materials.

In the original manufacture of the guitar many other means could be used to attach the cross member support bar. The bar could be attached, through the guitar top, directly to the bridge using various means including biscuits used to join wooden pieces.

I claim:

1. A device for attaching a bridge to a guitar top comprising a plurality of bracings below the guitar top; a cross member support bar with a first end and a second end; said first end placed below one bracing at one side of the bridge, and said second end placed below another bracing at another side of the bridge without touching the sides or bottom of the guitar such that the bracings and the guitar top are sandwiched between the bridge and the cross member support bar; and means for attaching the cross member support bar to the bridge.

* * * * *